US007612733B2

(12) United States Patent
Weiss et al.

(10) Patent No.: US 7,612,733 B2
(45) Date of Patent: Nov. 3, 2009

(54) TRANSITION REGION FOR USE WITH AN ANTENNA-INTEGRATED ELECTRON TUNNELING DEVICE AND METHOD

(75) Inventors: Manoja D. Weiss, Arvada, CO (US); Michael Klimek, Boulder, CO (US)

(73) Assignee: The Regents of the University of Colorado, Denver, CO (US)

( * ) Notice: Subject to any disclaimer, the term of this patent is extended or adjusted under 35 U.S.C. 154(b) by 196 days.

(21) Appl. No.: 11/684,840

(22) Filed: Mar. 12, 2007

(65) Prior Publication Data

US 2008/0224931 A1 Sep. 18, 2008

(51) Int. Cl.
*H01Q 21/00* (2006.01)

(52) U.S. Cl. ..... 343/860; 343/700 MS; 257/25; 257/30

(58) Field of Classification Search ..... 343/700 MS, 343/850, 860; 29/601; 257/25, 30
See application file for complete search history.

(56) References Cited

U.S. PATENT DOCUMENTS

| | | | | |
|---|---|---|---|---|
| 3,391,346 | A * | 7/1968 | Uhlir, Jr. | 330/4.9 |
| 4,630,081 | A * | 12/1986 | Calviello | 257/39 |
| 5,428,364 | A | 6/1995 | Lee et al. | |
| 5,598,169 | A | 1/1997 | Drabeck et al. | |
| 5,606,177 | A * | 2/1997 | Wallace et al. | 257/25 |
| 5,825,049 | A * | 10/1998 | Simmons et al. | 257/25 |
| 6,049,308 | A * | 4/2000 | Hietala et al. | 343/700 MS |
| 6,534,784 | B2 | 3/2003 | Eliasson et al. | |
| 6,563,185 | B2 | 5/2003 | Moddel et al. | |
| 6,664,562 | B2 | 12/2003 | Weiss et al. | |
| 6,806,833 | B2 * | 10/2004 | Anderson | 343/701 |
| 6,967,347 | B2 | 11/2005 | Estes et al. | |
| 7,010,183 | B2 | 3/2006 | Estes et al. | |
| 7,019,704 | B2 | 3/2006 | Weiss | |
| 7,105,852 | B2 * | 9/2006 | Moddel et al. | 257/30 |
| 7,126,151 | B2 | 10/2006 | Estes et al. | |

(Continued)

FOREIGN PATENT DOCUMENTS

| | | |
|---|---|---|
| WO | WO 00/35044 | 6/2000 |

OTHER PUBLICATIONS

R.W. Klopfenstein, "A transmission line taper of improved design," Proceedings of the IRE, pp. 31-35 (1956).

(Continued)

*Primary Examiner*—Tho G Phan
(74) *Attorney, Agent, or Firm*—Pritzkau Patent Group LLC

(57) ABSTRACT

An electron tunneling device includes a first non-insulating strip and a second non-insulating strip spaced apart from one another such that first and second end portions, respectively, of the first and second non-insulating strips cooperate to form an antenna having an antenna impedance. The first and second non-insulating strips include a transition region that extends from the antenna to a tunneling region in which the first and second non-insulating strips are in a confronting relationship. An arrangement cooperates with a portion of each of the first and second non-insulating strips in the tunneling region to form an electron tunneling structure exhibiting a tunneling region impedance. The transition region is configured to match the antenna impedance to the tunneling region impedance. The transition region can provide for changing an electromagnetic field orientation between the antenna and the tunneling region.

21 Claims, 9 Drawing Sheets

U.S. PATENT DOCUMENTS 7,177,515 B2 2/2007 Estes et al.

OTHER PUBLICATIONS

H. Shirasaki, "Design charts by waveguide model and mode-matching techniques of microstrip line taper shapes for satellite broadcast planar antenna," 2000 IEEE AP-S International Symposium and USNC/URSI National Radio Science Meeting, P-88-1, vol. 1, pp. 2000-2003 (2000).

J.P. Weem et al., "Broadband element considerations for SKA," *Perspectives on Radio Astronomy* (1999).

J.A. Oertel et al., "The large format x-ray imager," Review of Scientific Instruments, vol. 72, pp. 701-704 (2001).

W.M. Pozar, *Microwave Engineering*, John Wiley & Sons, Inc., New York, Chapter 5, Section 8, pp. 289-295 (1998).

* cited by examiner

TRANSITION REGION FOR USE WITH AN ANTENNA-INTEGRATED ELECTRON TUNNELING DEVICE AND METHOD

BACKGROUND

The present invention relates generally to electronic devices and, more particularly, to a transition region for use between an electron tunneling junction and a planar antenna connected therewith. The transition region is compatible with a variety of device configurations and antenna structures.

Prior art planar antennas are used at various frequency ranges such as, for example, microwave, millimeter wave and infrared frequencies to couple energy between a current pathway and free space. The planar configuration of these antennas enables ease of fabrication using electrically conductive layers formed on non-electrically conductive substrate materials. High speed electron tunneling device technology, developed by the Phiar® Corporation of Boulder, Colo., incorporates the advantages of the planar antenna with innovative tunneling junction structures, in order to provide high speed electron tunneling devices connected with one or more planar antennas for receiving or emitting electromagnetic radiation. Additionally, Phiar Corporation has developed modified planar antenna designs for use with electron tunneling devices. For example, U.S. patent application Ser. No. 09/860,988, now U.S. Pat. No. 6,534,784, and U.S. patent application Ser. No. 09/860,972, now U.S. Pat. No. 6,563,185 disclose high speed, metal-insulator electron tunneling devices capable of operating at frequencies even as high as in the optical range. U.S. patent application Ser. No. 10/103,054, now U.S. Pat. No. 7,010,183, and U.S. patent application Ser. No. 10/140,535, now U.S. Patent No. 7,177,515, disclose traveling wave configurations of the electron tunneling device. U.S. patent application Ser. No. 10/265,935, now U.S. Pat. No. 6,664,562 and U.S. patent application Ser. No. 10/335,731, now U.S. Pat. No. 7,019,704 describe improved antenna configurations suitable for use with these electron tunneling devices. U.S. patent application Ser. No. 10/337,427, now U.S. Pat. No. 7,126,151 discloses electron tunneling devices coupled with waveguides and placed on chips while providing, for example, inter- and intra-chip optical interconnections. In addition, U.S. patent application Ser. No. 10/462,491, now U.S. Pat. No. 6,967,347, describes the use of terahertz carrier frequency signals to provide an interconnection between components on a chip, between chips and the like. All of the aforementioned patents and patent applications are incorporated herein by reference in their entirety.

This overall, commonly owned group of patents and applications may be referred to collectively herein as the Phiar Patents. Since the Phiar Patents are considered to provide significant advantages over the then-existing state-of-the-art, the present disclosure is considered to describe still further highly advantageous advancements, as seen below.

There are numerous examples in the literature of transmission line taper designs for a single type of transmission line, such as an exclusively CPS or PP line. For example, Klopfenstein describes a taper design in which the transition between known, highly mismatched impedances may be accomplished in a very small distance (on the order of wavelengths) compared to other types of tapers while providing only small and readily controllable reflections in the passband [1]. The theory of Klopfenstein has been used in various applications such as, for instance, satellite antenna design [2], square kilometer antenna (SKA) project for outer space monitoring [3] and microstrip transmission lines [4], especially in the millimeter-wave and microwave frequencies. For a given value of a maximum reflection coefficient, it is generally acknowledged that the Klopfenstein taper produces the shortest impedance matching section (i.e., shortest transition region) in comparison, for example, to exponential or linear tapers.[5] For instance, Lee et al. discloses a transition region for use between an input stage and a radiating region in a slot line radiating element including flattened conductors fed by a coaxial cable.[6] As another example, Drabeck et al. provides an impedance matching, electrical circuit between a diode and an antenna for use in the RF frequencies.[7] Also, Hashemi-Yeganeh discloses a broadband microstrip to parallel plate waveguide transition including a metallic taper in a direction perpendicular to the substrate.[8] It is noted, however, that Hashemi-Yeganeh does not consider the rotation of electromagnetic field oscillation direction in transitioning between different transmission modes. Applicants are unaware of any work regarding the optimization of a transition region for impedance matching and/or change in mode of electromagnetic wave propagation.

The foregoing examples of the related art and limitations related therewith are intended to be illustrative and not exclusive. Other limitations of the related art will become apparent to those of skill in the art upon a reading of the specification and a study of the drawings.

REFERENCES

1. R. W. Klopfenstein, "A transmission line taper of improved design," Proceedings of the IRE, pp. 31-35 (1956).

2. H. Shirasaki, "Design charts by waveguide model and mode-matching techniques of microstrip line taper shapes for satellite broadcast planar antenna," 2000 IEEE AP-S International Symposium and USNC/URSI National Radio Science Meeting, P-88-1, vol. 1, pp. 2000-2003 (2000).

3. J. P. Weem et al., "Broadband element considerations for SKA," Perspectives on Radio Astronomy (1999).

4. J. A. Oertel et al., "The large format x-ray imager," Review of Scientific Instruments, vol. 72, pp. 701-704 (2001).

5. W. M. Pozar, Microwave Engineering, John Wiley & Sons, Inc., New York, Chapter 5, Section 8, pp. 289-295 (1998).

6. J. J. Lee et al., "Wide band dipole radiating element with a slot line feed having a Klopfenstein impedance taper," U.S. Pat. No. 5,428,364, issued Jun. 27, 1995.

7. L. M. Drabeck et al., "Detector and modulator circuits for passive microwave links," U.S. Pat. No. 5,598,169, issued Jan. 28, 1997.

8. S. Hashemi-Yeganeh, "Broadband microstrip to parallel-plate-waveguide transition," PCT App. Int'l Pub. No. WO 00/35044, published Jun. 15, 2000.

9. R. W. Klopfenstein, "A Transmission Line Taper of Improved Design," Proceedings of the IRE, 1956, pp. 31-35.

10. H. Shirasaki, "Design Charts by Waveguide Model and Mode-Matching Techniques of Microstrip Line Taper Shapes for Satellite Broadcast Planar Antenna," Dept. of Elec. Eng., Tamagawa University, Tokyo, Japan.

11. J. P. Weem, B. M Nostaros, and Z. Popovic, "Broadband Element Considerations for SKA," Perspectives on Radio Astronomy, 1999.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In one aspect of the present disclosure a tunneling device and associated method are described. The device includes a first non-insulating strip and a second non-insulating strip spaced apart from one another such that first and second end portions, respectively, of the first and second non-insulating strips cooperate to form an antenna having an antenna impedance. The first and second non-insulating strips include a transition region that extends from the antenna to a tunneling region in which the first and second non-insulating strips are in a confronting relationship. An arrangement cooperates with a portion of each of the first and second non-insulating strips in the tunneling region to form an electron tunneling structure exhibiting a tunneling region impedance, the arrangement being configured to support electron tunneling between and to the first and second non-insulating strips and the transition region is configured to match, at least to an approximation, the antenna impedance to the tunneling region impedance. In one feature, the transition region can provide for changing an electromagnetic field orientation between the antenna and the tunneling region.

In another aspect of the present disclosure, a tunneling device and associated method are described with a planar antenna exhibiting an antenna impedance and being configured to receive an input electromagnetic wave and to produce an electromagnetic field with a first field oscillation direction that is defined within an antenna plane. A transition arrangement is connected with the planar antenna and is configured to receive the electromagnetic field and to guide the electromagnetic field therethrough. The transition arrangement includes a coplanar strip (CPS) line arrangement including a first CPS end connected with the antenna and a second CPS end. The CPS line arrangement is configured such that the electromagnetic field propagates therethrough with the first field oscillation direction. A parallel plate (PP) arrangement includes a first PP end and an opposing, second PP end, which first PP end is connected with the second CPS end of the CPS line arrangement. The PP arrangement is configured to cooperate with the CPS line arrangement such that the electromagnetic field is rotated within the transition arrangement so as to emerge at the second PP end with a different, second field oscillation direction. A tunneling region exhibits a tunneling region impedance and is connected with the second PP end of the PP arrangement of the transition arrangement. The tunneling region is configured such that the electromagnetic field is supported therein with the different, second field oscillation direction.

In addition to the exemplary aspects and embodiments described above, further aspects and embodiments will become apparent by reference to the drawings and by study of the following descriptions.

BRIEF DESCRIPTION OF THE DRAWINGS

The present disclosure may be understood by reference to the following detailed description taken in conjunction with the drawings briefly described below. It is noted that, for purposes of illustrative clarity, the drawings may not be drawn to scale and are diagrammatic in nature, in a way that is intended to enhance the reader's understanding.

DETAILED DESCRIPTION

The following description is presented to enable one of ordinary skill in the art to make and use the invention and is provided in the context of a patent application and its requirements. Various modifications to herein described embodiments will be readily apparent to those skilled in the art and the generic principles taught herein may be applied to other embodiments. Thus, the present invention is not intended to be limited to the embodiment shown but is to be accorded the widest scope consistent with the principles and features described herein including alternatives, modifications and equivalents, as defined within the scope of the appended claims. It is noted that the drawings are not to scale and are diagrammatic in nature in a way that is thought to best illustrate features of interest. Further, like reference numbers are applied to like components, whenever practical, throughout the present disclosure. Descriptive terminology such as, for example, uppermost/lowermost, right/left, front/rear, top/bottom and the like has been adopted for purposes of enhancing the reader's understanding, with respect to the various views provided in the figures, and is in no way intended as being limiting.

In the context of a transition region between an antenna and a tunneling region (e.g., a diode region) in an electron tunneling device, Applicants recognize that the transition region should provide impedance matching between the antenna and the tunneling region. In some cases, it may be desirable for this transition region to be of a short length (such as on the order of a wavelength) and to produce minimal reflections, while accommodating the electromagnetic field oscillation direction in the antenna and the tunneling junction and any rotation therebetween.

Figure 1:
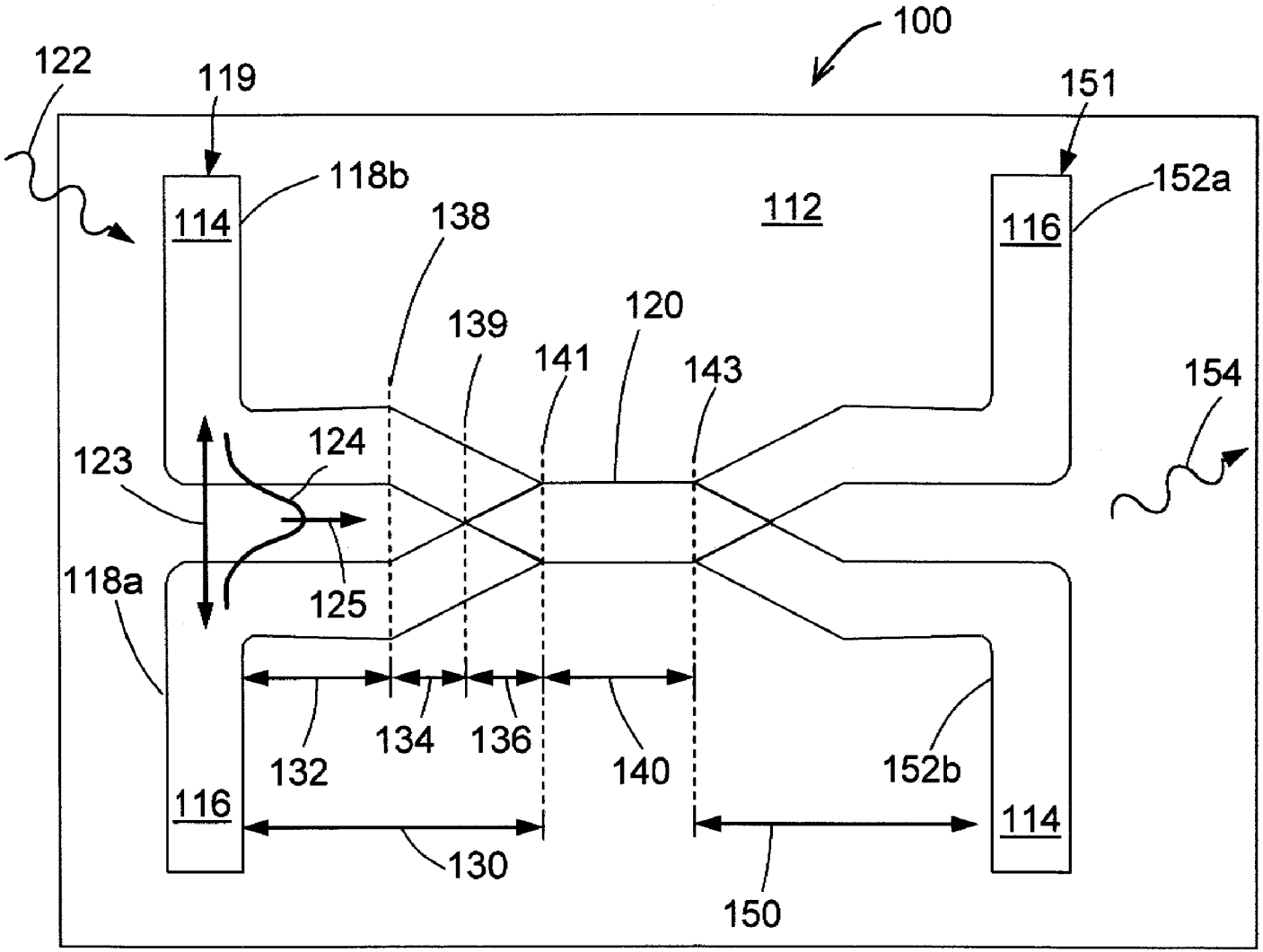
FIG. 1 is a diagrammatic plan view of one embodiment of an electron tunneling device configuration, shown here to illustrate the details of a transition region for use between input and output antennas and the tunneling region.

Attention is now directed to FIG. 1, which illustrates an embodiment of an electron tunneling device, shown in a diagrammatic plan view and generally indicated by the reference number 100. Electron tunneling device 100 includes a substrate 112 with first and second non-insulating and shaped layers 114 and 116, respectively, formed thereon. It is noted that such shaped layers may be referred to interchangeably hereinafter as layers or strips. Substrate 112 may be a supportive structure such as, for example, an insulator substrate, a wafer, a chip or a waveguide. A portion of first non-insulating strip 114 is shaped so as to form a first antenna arm 118*a*, which cooperates with a similarly formed, second antenna arm 118*b* formed from a portion of second non-insulating strip 116. First and second antenna arms 118*a* and 118*b* may cooperate to function as an input antenna which may be referred to as input antenna 119. For purposes of the present example, the first and second antenna arms form a dipole antenna, exhibiting a given antenna impedance.

Continuing to refer to FIG. 1, a part of first and second non-insulating strips 114 and 116 form a hexagonal, overlap tunneling region 120. For purposes of the present example, region 120 functions as a diode having a given diode/tunneling region impedance. Upon reception of an input signal 122 at input antenna 119, an electromagnetic field oscillation 123 (indicated by a double-headed arrow) is set up across first and second antenna arms 118*a* and 118*b* to generate an electromagnetic wave (indicated by a power curve 124) propagating in a propagation direction 125, indicated by an arrow. Portions of first and second non-insulating strips 114 and 116, between the input antenna and overlap section 120, are configured to form a transition region 130, the extent of which is indicated by a double-headed arrow. Transition region 130 includes a quarterwave transformer (QWT) 132, having a lateral span that is indicated by a double-headed arrow, a Co-Planar Strip (CPS) taper 134, the lateral extent of which is indicated by a double-headed arrow, and a Co-Planar Strip/Parallel Plate (CPS/PP) taper 136, the lateral span of which is indicated by a double-headed arrow. The various components of transition region 130 are discussed in more detail immediately hereinafter.

The components of transition region 130 are configured to provide impedance matching between input antenna 119 and overlap section 120 in three consecutive steps. Although the present discussion may be framed in terms of using antenna 119 to receive an electromagnetic signal that is then transferred to tunneling region 120, it is to be understood that the described impedance matching configuration is operative, irrespective of the direction of energy flow. That is, the tunneling junction may just as readily produce a signal that is transferred to and then emanated by antenna 119.

Continuing with the description of transition region 130, QWT 132 is basically a coplanar strip line with a length designed to "step down" the aforementioned antenna impedance to a lower, QWT output impedance at a first plane 138, which is indicated by a dashed line, and interfaces with CPS taper 134. CPS taper 134 is configured to further reduce the output impedance at first plane 138 down to a still lower, CPS output impedance at a second plane 139 while bringing the first and second non-insulating strips closer together. CPS/PP taper 136 may be considered as a combination of a continuation of the tapered coplanar strip line section in parallel with a gradually increasing, overlapped, parallel plate section such that the CPS output impedance at second plane 139 is matched to the aforementioned given tunneling region impedance at a third plane 141, which is indicated by a dashed line. The third plane forms a defined boundary of a main tunneling region 140 (the span of which is indicated by a double-headed arrow) in overlap section 120. In this way, transition region 130 can provide impedance matching between the input antenna and the tunneling junction or region.

Still referring to FIG. 1, various modifications to electron tunneling device 100 are described. For example, although CPS taper 134 and CPS/PP taper 136 are shown as linear tapers in FIG. 1, other types of tapers may be used. In this regard, the term "taper" refers to shaping or the shape of the width of the strips that are shown in the various figures in order to impose a desired impedance behavior. Thus, the strip width serves as an adjustable variable, although any other suitable parameter may be adjusted either alone or in combination with changing strip width for purposes of accomplishing a particular impedance profile. In the instance of using a taper, an exponential or Klopfenstein taper may be used instead of a linear taper, as one or both of CPS taper 134 and CPS/PP taper 136. Also, the taper configuration may be repeated beyond diode region 140 past a fourth plane 143 in a second transition region 150, the lateral extents of which are indicated by an arrow. For example, second transition region 150 may interface with an output antenna 151 that is composed of portions of first and second non-insulating strips 114 and 116 forming third and fourth antenna arms 152*a* and 152*b*, respectively. Furthermore, although transition region 130 is shown in FIG. 1 as including three impedance transformations, a greater or fewer number of impedance transformations may be used, depending on the selected taper type. It should be noted that the use of a plurality of transformations for impedance matching is potentially advantageous since Applicants recognize that the combination of a succession of different impedance matching transformations, in general, requires less substrate real estate.

Figure 2A:
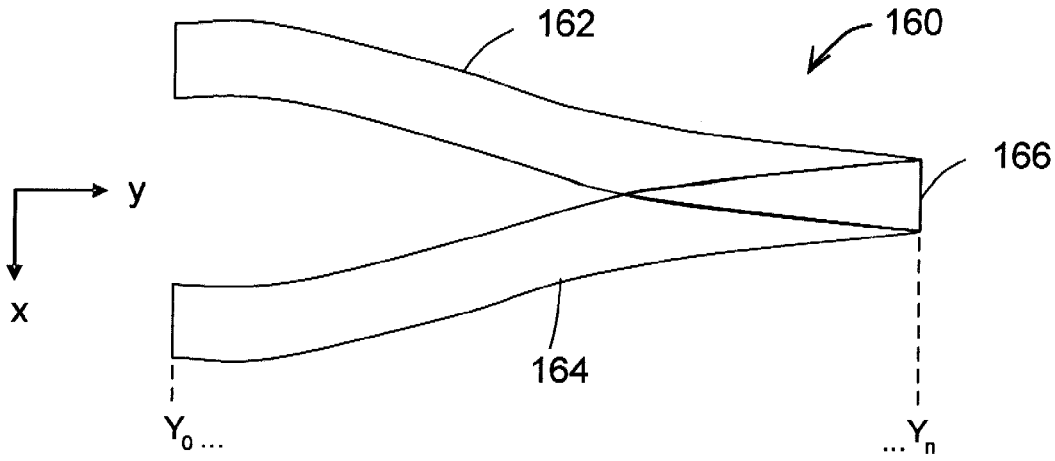
FIGS. 2A and 2B are diagrammatic illustrations of one embodiment of the transition region, shown here to illustrate the details of tapered structure segments for use in one embodiment of a design process.

Attention is now directed to an exemplary design process for designing the tapered components in transition region 130 of FIG. 1 with reference to FIGS. 2A-2B and 3A-3B. FIG. 2A illustrates a starting point, hypothetical structure, generally indicated by the reference number 160, which is used in the design process. As shown in FIG. 2A, hypothetical structure 160 includes first and second strips 162 and 164, respectively, which partially overlap to form an overlap section 166. The general configuration of first and second strips 162 and 164 of the hypothetical structure corresponds to transition region 130 of electron tunneling device 100 shown in FIG. 1. The dimensions of the various sections of the hypothetical structure are determined as will be discussed in further detail immediately hereinafter.

Figure 2B:
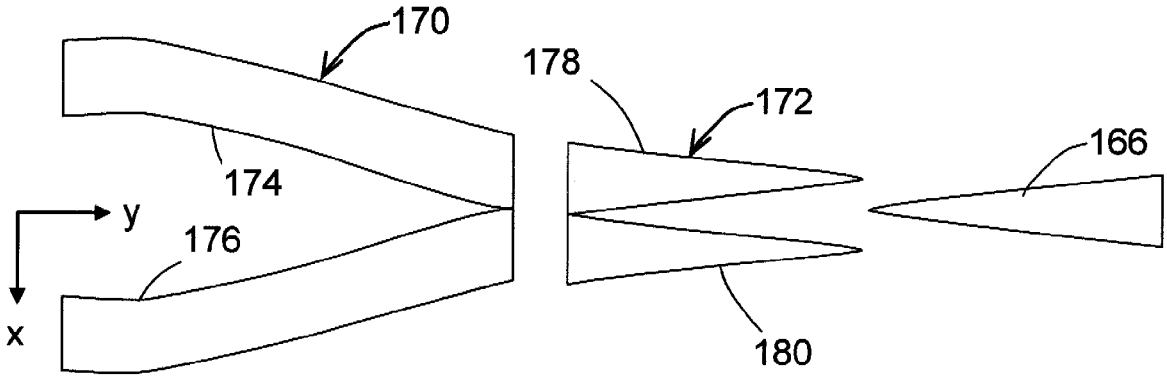

FIG. 2B illustrates the division of hypothetical structure 160 into three sections, each of which is considered separately in the design process. As shown in this figure, hypothetical structure 160 is divided into a first CPS taper section 170, a second CPS taper section 172 and an overlap section 166 (which is essentially a Parallel Plate, PP, taper section). First CPS taper section 170 is assumed to be formed of first and second lines 174 and 176, respectively, which lines gradually come closer together, from left to right in the view of the figure, while the widths of the lines remain constant. Second CPS taper section 172 includes first and second segments 178 and 180, each of which tapers from the width of a respective one of first and second lines 174 and 176 down to a point, from left to right in the view of the figure. PP taper section 166 increases in width from a point to a given width, from left to right in the view of the figure, such that the increase in width of PP taper section 166 complements the tapering in width of first and second segments 178 and 180 of second CPS taper section 172. Thus, the given width at the end of section 166 may at least generally match the width of lines 174 and 176. Each of these three sections is simulated separately, the results are then combined to develop a single, continuous solution, as will be described below.

Figure 3A:
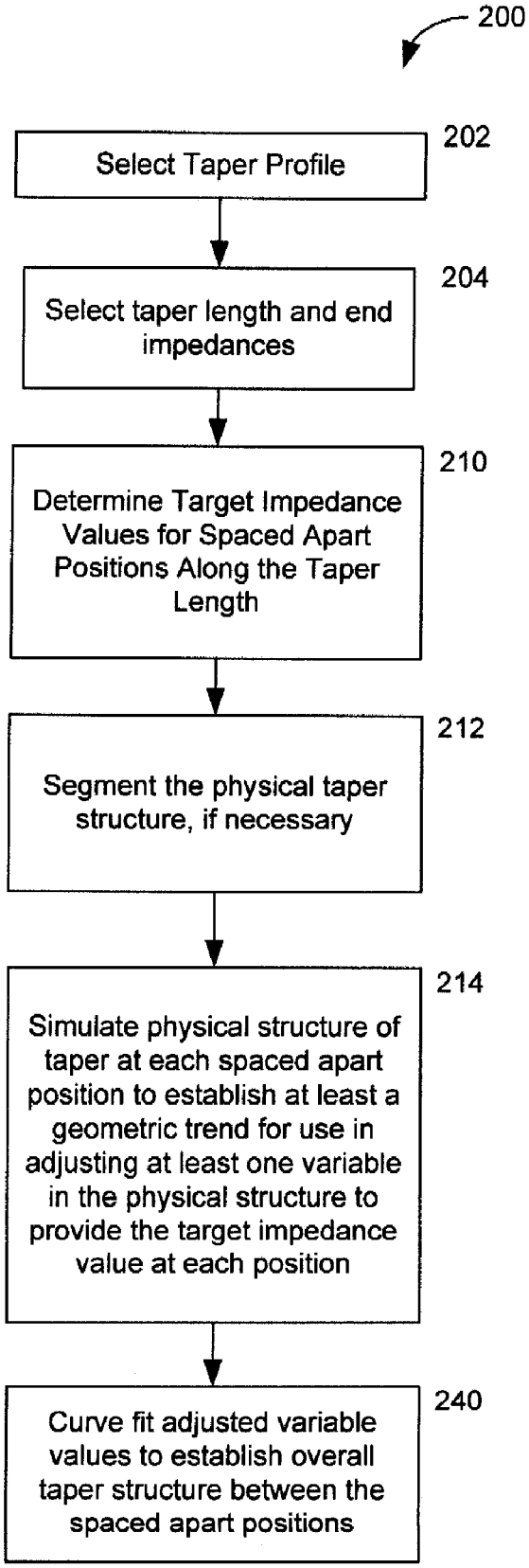
FIGS. 3A and 3B are flow diagrams of an exemplary procedure for use in the design of a transition region between the antenna and the tunneling region of an electron tunneling device for purposes of providing impedance matching therebetween.
Figure 3B:
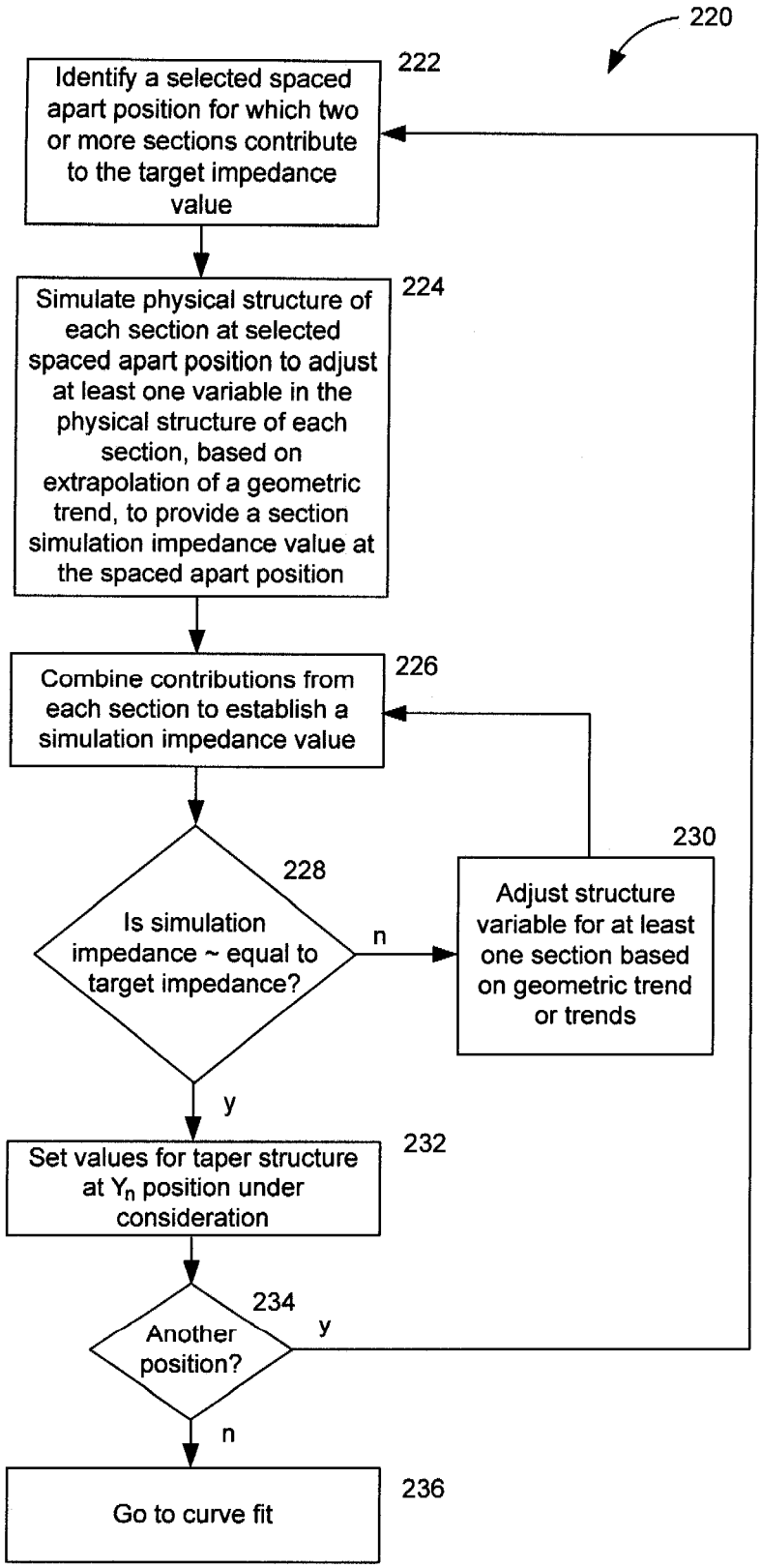

Referring now to FIGS. 3A and 3B in conjunction with FIGS. 2A and 2B, one embodiment of the design procedure is described. FIG. 3A is a flow diagram illustrating a design procedure for formulating the transition region that is generally indicated by the reference number 200. Selection of a taper profile is performed at 202. The taper profile chosen may be, for example, a linear, exponential or Klopfenstein taper profile. Then, in 204, the length for the taper in a y-direction (see FIGS. 2A and 2B ) is specified along with impedances that are needed at its opposing ends for impedance matching purposes. For example, it may be known that the ideal length of the taper in the y-direction is a certain ideal length, such as a certain fraction of a wavelength at which the electron tunneling device is designed to function so as to minimize the reflection coefficient of the taper section. However, in certain situations, the ideal length may not be practical for fabrication. For example, the ideal taper length may be less than a micron for a transition region that is intended for use with optical wavelengths. If fabrication of a taper of particularly small dimensions is difficult using the state-of-the-art techniques, the length of the taper in the y-direction may be specified, for instance, to be a length slightly longer than the ideal taper length, while keeping the reflection coefficient at an acceptable level. Moreover, modification of the taper length can provide for selectivity in the width of the passband.

Continuing with the description of procedure 200, after the taper profile, the taper length and the end impedances have been selected, an impedance profile corresponding to the taper profile over the taper length is determined at 210. This determination may be performed, for example, in a commercial electromagnetic modeling software such as Zeland IE3D™ distributed by Zeland Software Inc. For convenience, the taper length may be divided into segments such that the impedance may be calculated at a discrete number of points along the taper length. In the example of FIG. 2A, the taper length is divided into twenty segments such that an impedance Z is calculated at discrete taper lengths or positions $Y_n$ (see FIG. 2A). It is noted that the impedance that is desired for each of the $Y_n$ positions may be thought of as a target impedance. For a given $Y_n$ position, the manner in which the actual impedance is determined will depend upon the structure of the taper at that position, as will be seen. In the present example, twenty $Y_n$ positions are used, although any suitable number can be used.

Still referring to FIG. 3A, the physical configuration of the transition region is taken into account in step 212. In particular, the transition region configuration may be segmented so as to provide for more convenient analysis. For example, referring briefly to FIG. 1, the transition region may be specified as CPS taper 134 serving as a first segment that is connected with CPS/PP taper 136, serving as a second segment. This transition region having an input impedance defined at first plane 138 and an output impedance defined at third plane 141. For purposes of simplicity, QWT 132 is excluded from the determinations in relation to FIGS. 3A and 3B because the dimensions of QWT 132 are readily determined in a well known manner from the wavelength of the electromagnetic field to be propagated through the electron tunneling device, in combination with the material properties of the non-insulating strips. The first segment (section 170), which corresponds to CPS taper 134, is considered as a CPS line with a diminishing taper (from left to right in FIG. 2B) in the spacing between the two strips composing the CPS taper. The second segment, which corresponds to CPS/PP taper 136, is characterized by the strips themselves being tapered or diminishing in width from left to right in the view of FIG. 2B. Furthermore, as described in reference to hypothetical structure 160 of FIGS. 2A and 2B, the second segment, CPS/PP taper may be considered as being formed of CPS taper section 172 and PP taper section 166, as shown in FIG. 2B, having complementary shapes.

Referring to FIGS. 2B and 3A, at 214, the physical structure of the taper is established for the spaced apart positions $Y_n$ along the taper as imposed by the selected impedance profile, taper length, taper end impedances and structural characteristics of the taper. For each of the spaced apart positions $Y_n$ at which the target impedance profile is known, the taper structure is simulated to establish at least one trend in the value of actual impedance that is provided at that position, responsive to changing at least one variable in the physical structure of the taper. For example, with respect to first, CPS segment 134 (or CPS taper section 170 in FIG. 2B), spacing between the strips may serve as the variable. In this way, the physical structure can be established, corresponding to each of the $Y_n$ positions that occur along the first segment. It should be appreciated, however, that the simulation task is somewhat more difficult with respect to $Y_n$ positions that occur along the second segment because the second segment is being considered as two sections, as will be described below. The initial shape may be assumed, as well as the material properties of the segment that is under consideration. For instance, as described earlier, first CPS taper section 170 may be assumed to be formed of first and second lines 174 and 176, respectively, each line having a fixed width of 200 nm, for instance, while the spacing between the two lines is varied from 200 nm down to 0 nm. Similarly, second CPS taper section 172 is assumed to begin with adjacent first and second segments 178 and 180 each having a width of 200 nm and narrowing uniformly on both edges to a point such that tips of the points of first and second segments 178 and 180 are separated by 200 nm. PP taper section 166 is assumed to have a complementary increase in width from a point to a 200 nm width corresponding to the taper of second CPS taper section 172.

Turning to FIG. 3B, in conjunction with FIG. 3A, the former illustrates a procedure 220 that is applied for $Y_n$ positions at which two or more sections contribute to establishing the target impedance value. Initially, at 222, a $Y_n$ position is identified for which more than one taper section will contribute to the target impedance value. In the present example, this Y position is along the second segment. Accordingly, at 224, a simulation of the physical structure of each section is performed in order to establish a trend in at least one physical variable with respect to each section. In the present example, the physical variable for PP section 180 may be the width of the spaced apart strips, while the physical variable for PP section 166 may, likewise, be its width. It is recognized, in this regard, that selection of the width of strips 178 and 180 of the first section for a particular Y position, at least partially establishes the width of strip 166 for that particular $Y_n$ position due to the complementary shapes of the first and second sections with respect to one another. Having established a trend for the variable associated with each section, extrapolation of these trends is used to establish a simulation value for each "structure" variable, along with an associated simulation impedance contribution from each section, that may result in the target impedance value for the $Y_n$ position that is under consideration. Moving to 226, with simulation values for each variable in hand, along with an associated simulation impedance for each section, the associated simulation impedance contributions from each section can be combined to establish a simulation impedance for the given $Y_n$ position. In the present example, the CPS section and the PP section are in parallel such that the impedance contribution from each section, for a given $Y_n$ position, can be combined on the basis of being in parallel. Step 228 then checks whether the simulation impedance is at least approximately equal to the target impedance value for the for the $Y_n$ position under consideration. If the test is not satisfied, step 230 then adjusts the structure variable for at least one section, based on extrapolation of the observed trends. Step 226 then determines new simulation values and step 228 tests these new simulation values against the target impedance for the $Y_n$ position that is under consideration. Steps 226, 228 and 230 repeat in a loop fashion until the simulation values satisfy the test of step 228 by matching the target impedance value to within some approximation. If the test of step 228 is satisfied, step 232 then sets the simulation values for the given $Y_n$ position that is under consideration as actual physical dimensions for the taper at the given $Y_n$ position. Step 234 causes the process to repeat for the next $Y_n$ position where two or more sections contribute to the impedance. Step 236 then refers the procedure to a curve fit process that is part of FIG. 3A, as will be described immediately hereinafter.

Referring again to FIG. 3A, having completed simulation of the taper structure in step 214, for every $Y_n$ position, the physical structure of the taper is known. Step 240 then uses this data to curve fit between the $Y_n$ positions to establish a continuous, overall taper structure.

Figure 3C:
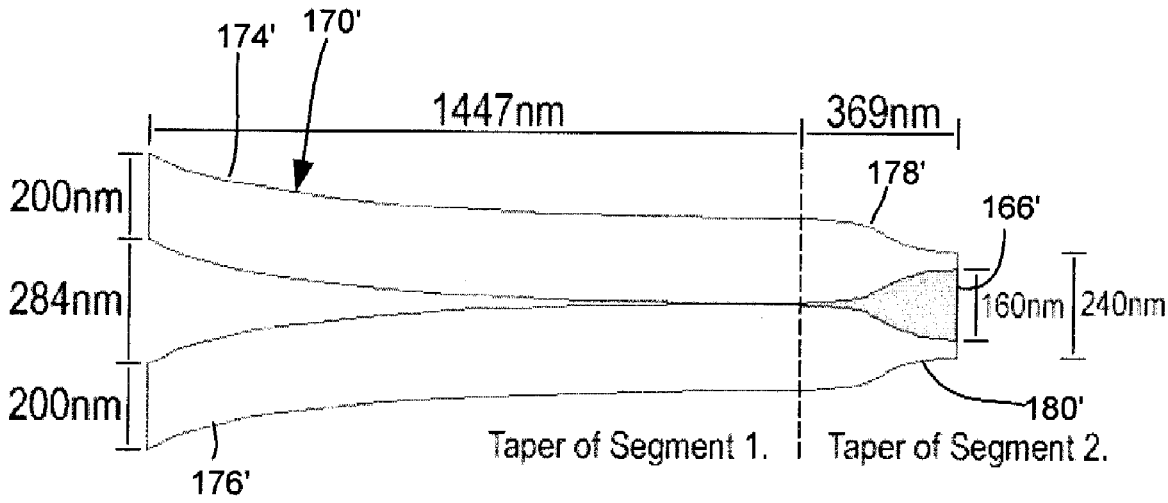
FIG. 3C is a diagrammatic plan view of a Klopfenstein taper structure designed in accordance with the exemplary procedure shown in FIGS. 3A and 3B.

An example of a taper section designed in accordance with this procedure, based on a Klopfenstein taper configuration, is shown in FIG. 3C. It should be noted that 200 nm was chosen as the maximum line width, since smaller widths are difficult to obtain with the currently state of fabrication technology. However, since more efficient tapers are potentially possible using narrower or wider line widths depending on the frequency at which the device is to be operated, the aforedescribed procedure is considered to encompass designs based on line widths greater than or less than the 200 nm width used for the above determinations. Additionally, any suitable shape configurations for the taper sections are possible and may be readily taken into account in the aforedescribed design procedure. It should be appreciated that the described procedure produces an impedance matched taper for a CPS to PP transition region. Further, it is considered that this procedure is readily adaptable to other transition regions, since the described taper for CPS to PP transition is considered to be among the most difficult, designs to implement.

Figure 4A:
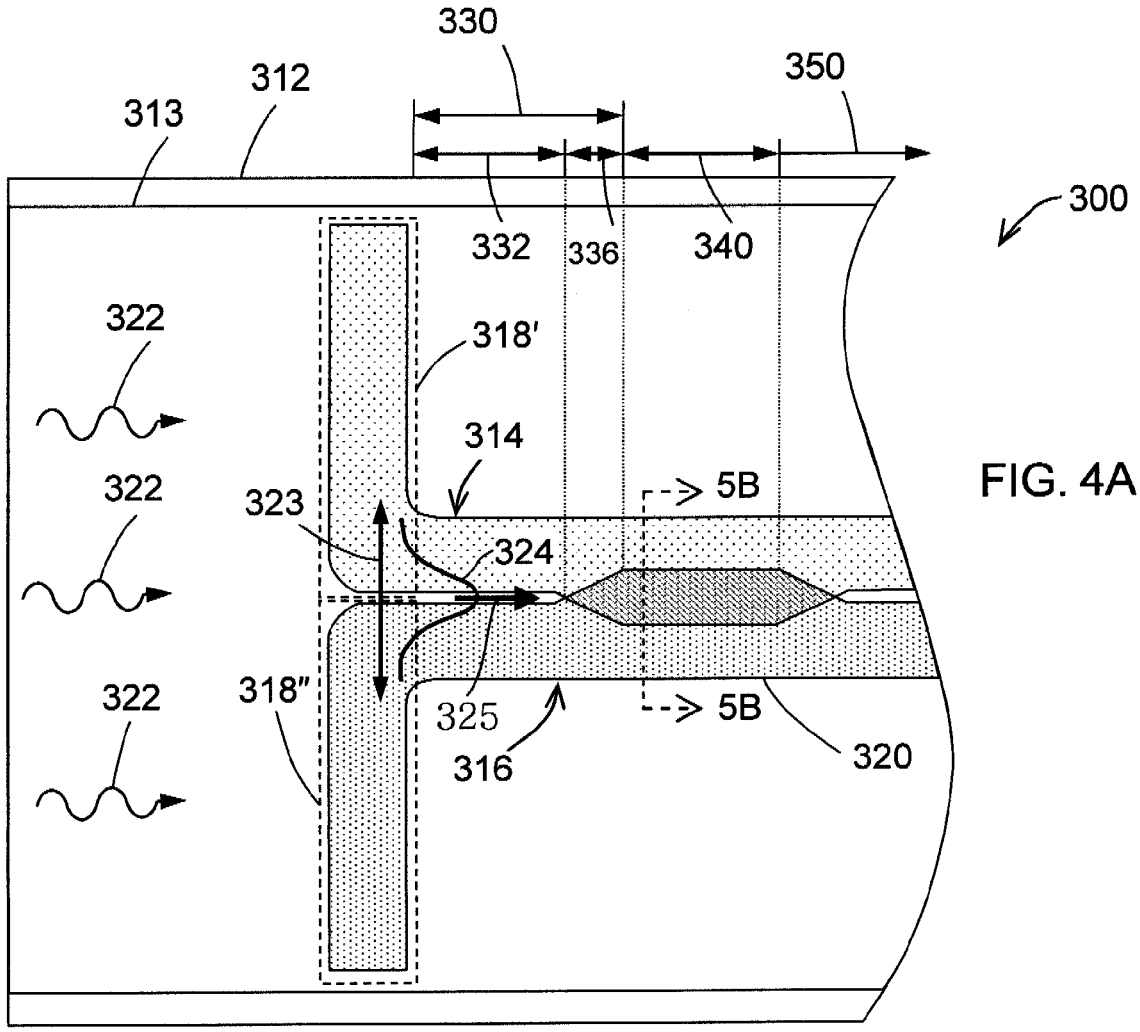
FIG. 4A is a diagrammatic plan view of another embodiment of an electron tunneling device configuration, shown here to illustrate the use of an overlapping parallel plate (OPP) tunneling region configuration.

Turning now to FIG. 4A, another embodiment of an electron tunneling device, including an impedance matched transition region as well as an overlapping parallel plate tunneling region, is illustrated in a diagrammatic plan view and generally indicated by the reference number 300. Electron tunneling device 300 includes a substrate 312 with a waveguide 313 disposed thereon. First and second non-insulating strips 314 and 316, respectively, are formed, at least in part, directly on top of waveguide 313. A portion of first non-insulating strip 314 is shaped so as to form a first antenna arm (within a dashed box 318'), which cooperates with a similarly formed, second antenna arm (within a dashed box 318") formed from a portion of second non-insulating strip 316. First and second antenna arms 318' and 318" cooperate to function as an antenna. In the embodiment shown in FIG. 4A, first and second antenna arms 318' and 318" cooperate to form a dipole antenna with a given antenna impedance.

Continuing to refer to FIG. 4A, first and second non-insulating strips 314 and 316 are configured to partially overlap so as to form an overlap section 320. When an input signal 322, which is guided through waveguide 313, passes under the input antenna portion of electron tunneling device 300, a portion of input signal 322 is coupled into first and second antenna arms 318' and 318". As a result, an electromagnetic field oscillation 323 (indicated by a double-headed arrow) is set up at across first and second antenna arms 318' and 318" to generate an electromagnetic wave 324 (indicated by a power curve) propagating in a propagation direction 325 indicated by an arrow. First and second non-insulating strips 314 and 316 also cooperate to form a transition region 330 (the span of which is indicated by a double-headed arrow). Transition region 330 includes a quarterwave transformer (QWT) 332 (the lateral extent of which is indicated by a double-headed arrow) and a CPS/PP taper 334 (the span of which is indicated by a double-headed arrow). In comparison to transition region 130 of electron tunneling device 100 as shown in FIG. 2, transition region 330 of electron tunneling device 300 may be more compact due to the elimination of a CPS taper portion. In another embodiment, first and second antenna arms 318' and 318" may be further separated such that a distinct, CPS taper portion may be included in the transition region, while maintaining the overlapping parallel plate tunneling junction configuration. Overlap section 320 is connected with a second transition region 350, indicated by an arrow and only partially illustrated. For instance, second transition region 350 may interface with an output antenna (not shown).

Figure 4B:
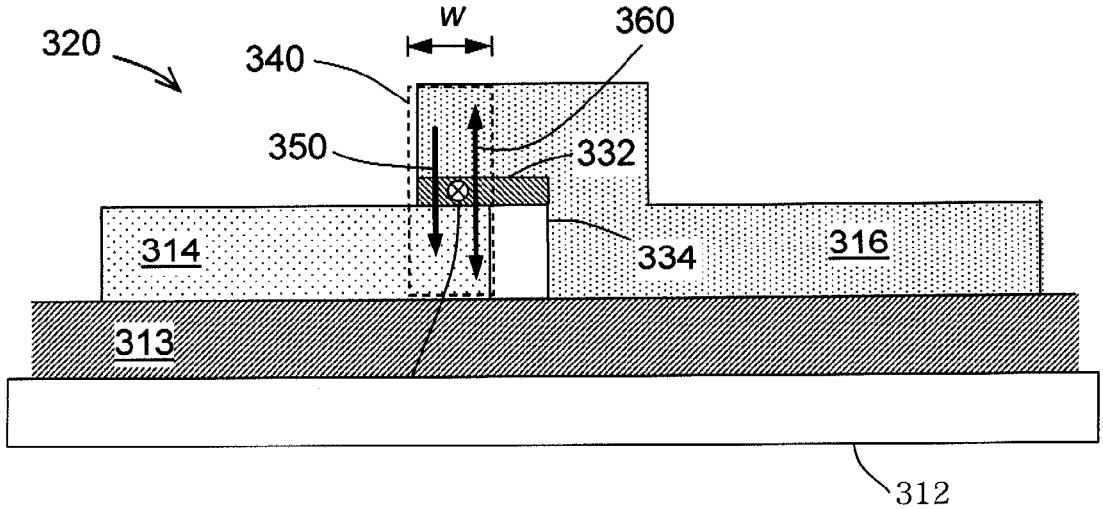
FIG. 4B is a diagrammatic view, in cross section, of the overlapping parallel plate diode of the electron tunneling device configuration of device of FIG. 4A, shown here to illustrate details of the OPP tunneling region.
Figure 5A:
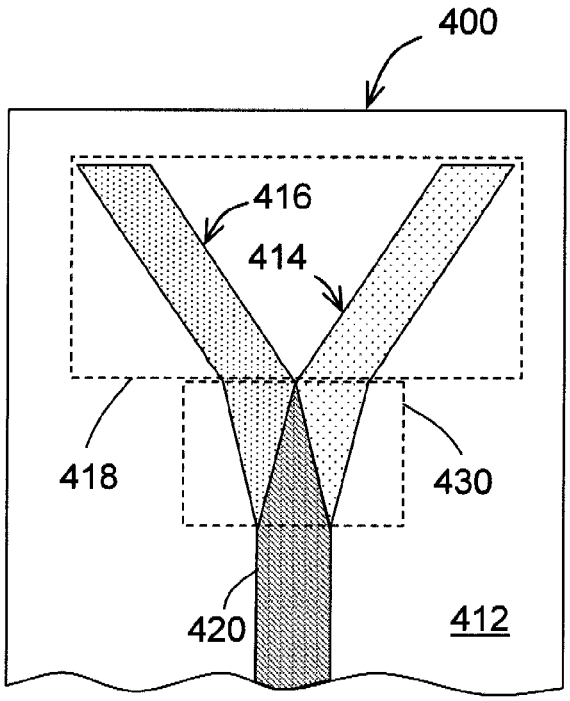
FIGS. 5A and 5B are diagrammatic plan views of two possible embodiments of an electron tunneling device configuration, shown here to illustrate the incorporation of tapers into the design of the antenna as well as the transition region.

FIG. 4B is a diagrammatic cross-sectional view, in elevation, of a possible configuration for tunneling region 320 of electron tunneling device 300 as shown in FIG. 5A. As may be seen in FIG. 4B, first non-insulating strip 314 is formed on waveguide 313. Second non-insulating strip 316 is also deposited on waveguide 313 so as to partially overlap first non-insulating strip 314. First and second non-insulating strips 314 and 316, however, are separated by an insulating layer 332 and a passivation strip 334. Insulating layer 332 is configured to provide for electron tunneling while passivation layer 334 is configured to inhibit electron tunneling, as compared to insulation layer 332. For example, as one feature, insulation layer 332 can be much thinner than passivation strip 334, such that electron tunneling occurs between first and second non-insulating strips 314 and 316 through insulating layer 332 in a diode/tunneling region 340, within a dashed box, in a direction 350, indicated by an arrow, rather than through passivation strip 334. As a result, as was the case in electron tunneling device 100 of FIG. 2, the electromagnetic field oscillation direction in electron tunneling device 300 is rotated from being in the plane of the antenna, as indicated by double-headed arrow 323, to being perpendicular to the plane of the substrate in diode region 340, as indicated by a double-headed arrow 360. Propagation direction 325 of the electromagnetic wave remains the same through the electron tunneling device. Specific material composition of diode section 320 may be, for example, the various combinations of materials as disclosed in the Phiar patents, as well as the above incorporated applications that are being filed contemporaneously herewith.

Continuing to refer to FIGS. 4A and 4B, the overlapping parallel plate configuration of electron tunneling device 300 may be advantageous because the dimensions of tunneling region 340 are readily controllable using currently available fabrication techniques. That is, the distance between first and second non-insulating strips in tunneling region 340 may be regulated, at least in part, by controlling the thickness of insulating layer 332, and the width of the diode region (indicated as w in FIG. 4B) may be controlled by adjusting the overlap of second non-insulating strip 316 with first non-insulating strip 314.

Figure 5B:
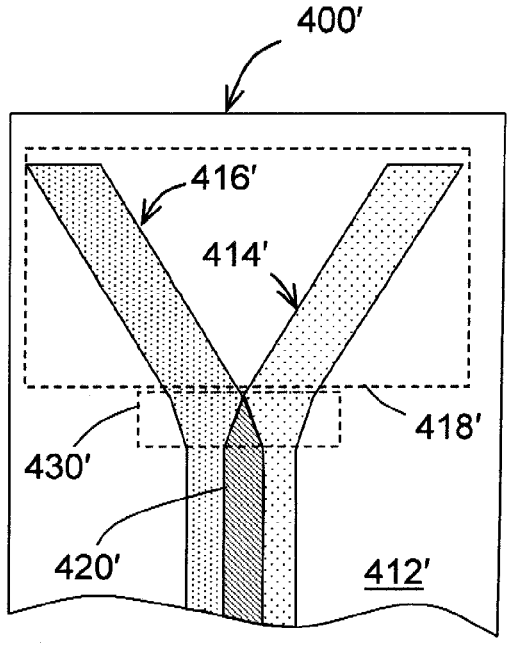

Turning now to FIGS. 5A and 5B, additional antenna and taper configurations are described. First considering FIG. 5A, an electron tunneling device 400 includes a substrate 412 with first and second non-insulating strips 414 and 416, respectively, disposed thereon. A portion of first and second non-insulating strips 414 and 416 is configured to form a linearly tapered, printed dipole or V antenna, enclosed by a dashed box 418. First and second non-insulating strips 414 and 416 overlap in a confronting, but electrically isolated relationship to form an overlap section 420 which also serves as a tunneling region. Another portion of first and second non-insulating strips 414 and 416, between the antenna and the tunneling region, forms a CPS/PP taper region, enclosed by a dashed box 430. Since first and second non-insulating strips 414 and 416 completely overlap in tunneling region 420, electron tunneling device 400 is analogous, at least in this respect, to electron tunneling device 100 of FIG. 2.

Continuing to refer to FIG. 5A, electron tunneling device configuration 400 is of interest because a part of the transition between the antenna and the diode/tunneling region is integrated into the design of the antenna itself. That is, antenna 418 is linearly tapered so as to aid in impedance matching between the antenna and the tunneling region. Thus a relatively compact device may be produced. In addition, shorter transmission lines, particularly at higher frequencies, can lessen loss of signal into the substrate. It is understood that this taper in the antenna will result in a different radiation pattern than the untapered antenna.

FIG. 5B shows an overlapping parallel plate (OPP) embodiment of the electron tunneling device of FIG. 5A. Accordingly, an electron tunneling device 400' includes a substrate 412' with first and second non-insulating strips 414' and 416', respectively, disposed thereon. As in electron tunneling device 400 of FIG. 5A, a portion of first and second non-insulating strips 414 and 416 is configured to form a linearly tapered antenna, which is enclosed by a dashed box 418'. First and second non-insulating strips 414' and 416' partially overlap in a confronting, but electrically isolated relationship to form an overlap section 420'. Unlike in electron tunneling device 400 of FIG. 5A, however, first and second non-insulating strips 414' and 416' of electron tunneling device 400' overlap only along one edge, in a manner analogous, at least in this respect, to OPP electron tunneling device 300 of FIG. 4A, such that major surfaces of the strips confront one another in overlap region 420', which serves as a tunneling region. A portion of first and second non-insulating strips 414' and 416' forms a CPS/PP taper region 430', enclosed by a dashed box. Since overlap/tunneling region 420' may be relatively smaller than overlap 420 in FIG. 5A, CPS/PP taper region 430' may be smaller and shorter than the corresponding CPS/PP taper region 430 of electron tunneling device 400.

Yet other embodiments of electron tunneling devices are illustrated in FIGS. 6A-6D, which show two configurations, including an edge-diode tunneling region coupled with a planar antenna. Initially referring to FIG. 6A, an electron tunneling device 500 includes a substrate 512 with first and second non-insulating strips 514 and 516, respectively, disposed thereon. A portion of first and second non-insulating strips 514 and 516 is configured to form a linearly tapered, antenna 518 (enclosed by a dashed box). Another portion of first and second non-insulating strips 514 and 516 is configured to form a transition region 530, within a dashed box. As in the electron tunneling devices shown in FIGS. 5A and 5B, slot antenna 518 incorporates a tapered configuration that may enable a shortening of the transition region in comparison, for example, to an antenna configuration including a dipole or bowtie antenna. Still another portion of first and second non-insulating strips 514 and 516 is configured to form an edge-diode tunneling region 540 within a dashed box. Edge-diode tunneling region 540 is essentially formed using confronting edges or sidewalls of sections of first and second non-insulating strips 514 and 516 disposed in a close proximity to, but not overlapping with, one another such that electron tunneling may take place therebetween in a plane parallel to the plane of the substrate. Further details of the edge-diode tunneling region configuration are described immediately hereinafter.

Figure 6A:
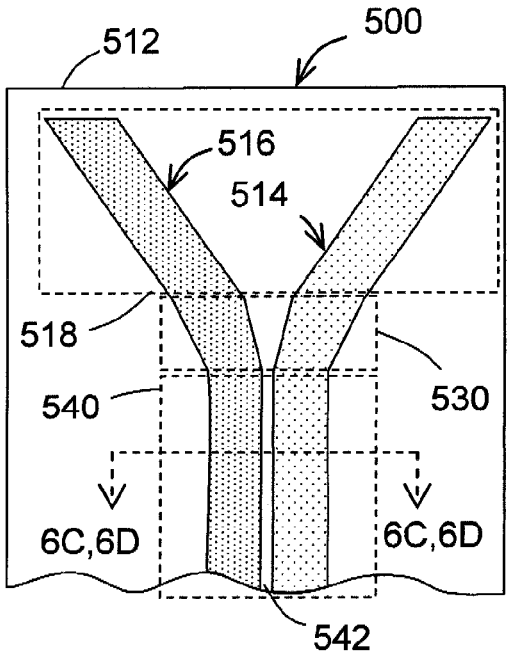
FIGS. 6A and 6B are diagrammatic plan views of another two possible embodiments of the electron tunneling device configurations, shown here to illustrate the use of an edge diode tunneling configuration in the tunneling region.
Figure 6B:
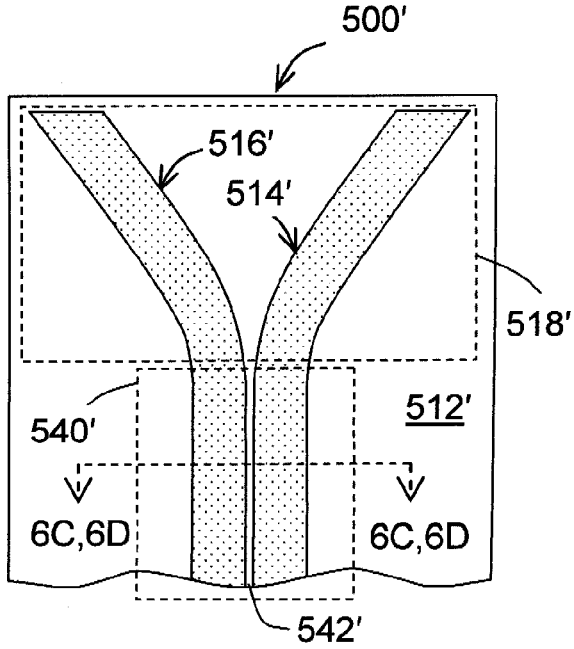
Figure 6C:
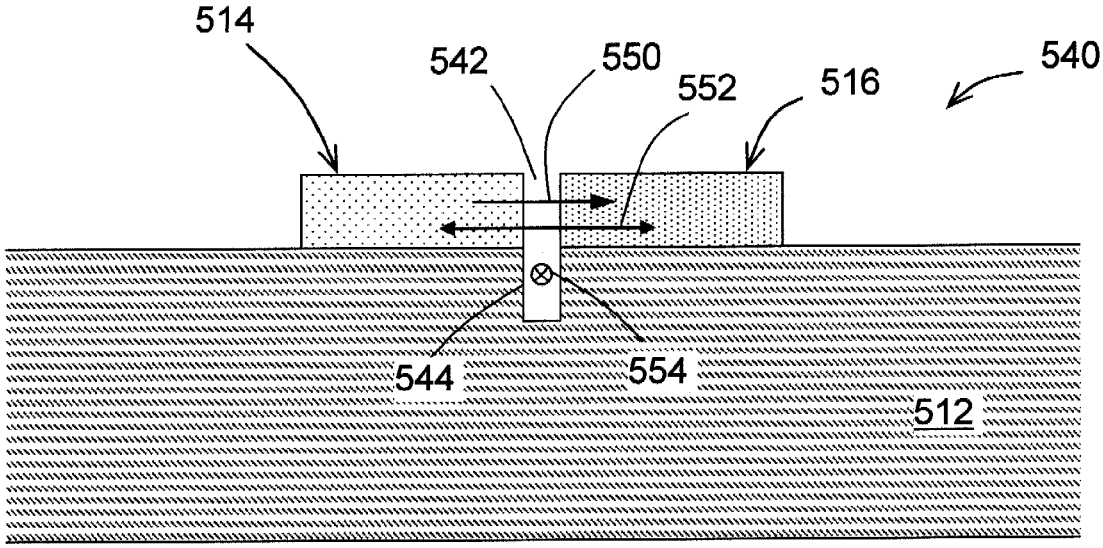
FIGS. 6C and 6D are diagrammatic views, in cross-sectional elevation, showing possible embodiments of the edge diode of the electron tunneling device configurations illustrated in FIGS. 6A and 6B.
Figure 6D:
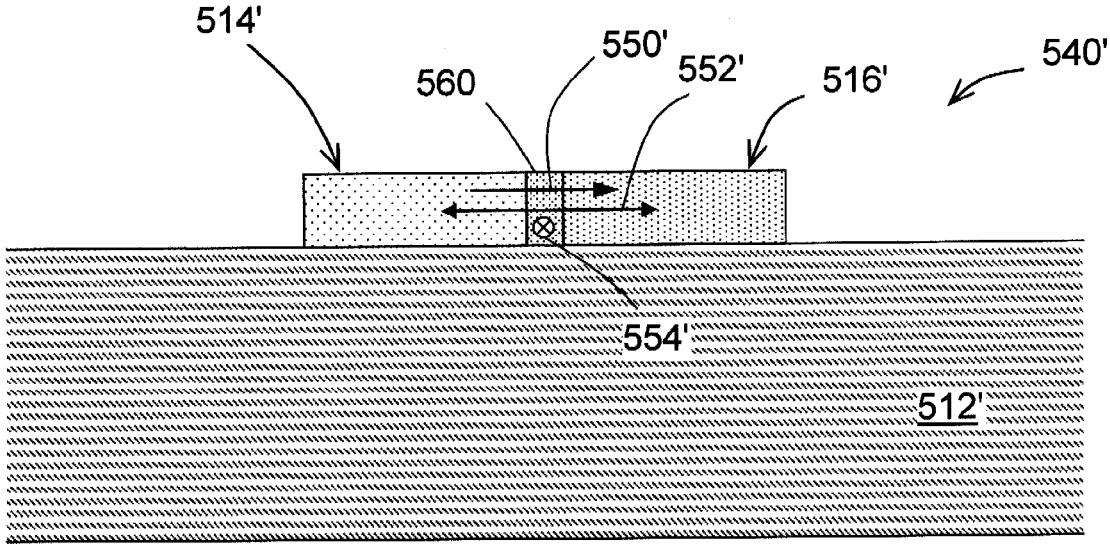

Referring to FIGS. 6C and 6D, diagrammatic cross-sectional views, in elevation, of possible configurations for edge-diode tunneling region 540 of FIG. 6A are shown. As described earlier, edge-diode tunneling region 540 includes first and second non-insulating strips 514 and 516 disposed parallel to each other on substrate 512. In the embodiment shown in FIG. 6C, an air gap 542 separates first and second non-insulating strips 514 and 516. Furthermore, a trench 544 is formed in substrate 512 to ensure separation between first and second non-insulating strips 514 and 516. Confronting sidewalls of first and second non-insulating strips 514 and 516 are located in close proximity such that electron tunneling may occur therebetween in a direction, for example, indicated by an arrow 550. As a result, electromagnetic field oscillation (indicated by a double-headed arrow 552) is set up between first and second non-insulating strips 514 and 516 such that an electromagnetic wave 554 is guided therethrough (indicated by a symbol). In order to produce electron tunneling, the non-insulative materials which may be used to form non-insulating strips 514 and 516 may be selected, for example, as described in the above incorporated Phiar-19 application.

Another embodiment of an edge-diode tunneling region is shown in FIG. 6D, generally indicated by the reference number 540' and shown in a diagrammatic, cross-sectional view, in elevation. In edge-diode tunneling region 540', a substrate 512' does not include a trench (in contrast to substrate 512 of FIG. 6C), while first and second non-insulating strips 514 and 516 are separated by an insulating layer 560 rather than an air gap. Insulating layer 560 is formed of at least one material for supporting electron tunneling therethrough while being compatible with the materials forming first and second non-insulating strips 514 and 516 as well as the fabrication process thereof.

Returning now to FIG. 6B, another configuration of an edge-diode electron tunneling device is shown in a diagrammatic plan view. An electron tunneling device 500' is similar to electron tunneling device 500 of FIG. 6A but includes first and second non-insulating strips 514' and 516', a part of which forms an exponentially tapered, Vivaldi antenna 518' (enclosed by a dashed box). Vivaldi antenna 518' may be beneficial because the tapered configuration of the antenna itself serves as a smooth, transition region into edge-diode 540. That is, rather than having a separate transition region from the antenna, the transition into the diode region is incorporated into the design of the antenna itself.

Figure 7:
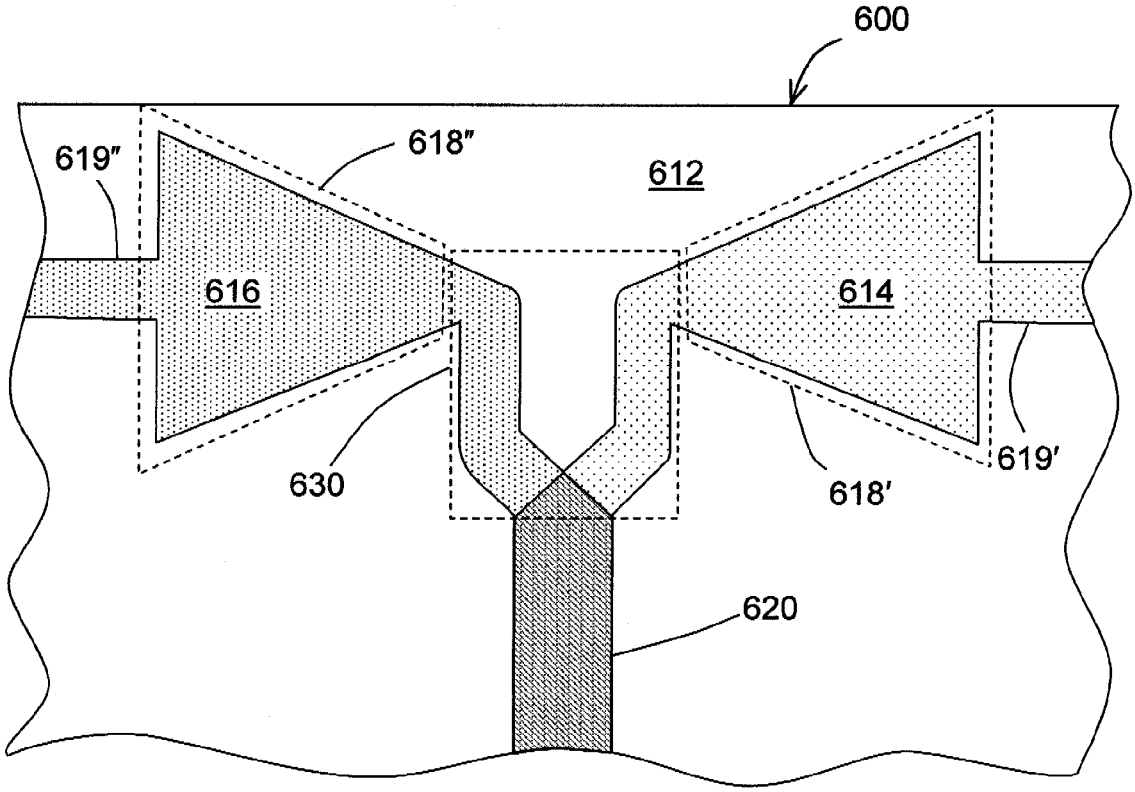
FIG. 7 is a diagrammatic plan view of an edge-fed, bowtie antenna configuration of the electron tunneling device according to the present disclosure.

Turning now to FIG. 7, an electron tunneling device including a bowtie antenna combined with a transition region into a tunneling region is shown. An electron tunneling device 600 includes a substrate 612 including first and second non-insulating strips 614 and 616, respectively, formed thereon. A portion of each of first and second non-insulating strips 614 and 616 is configured such that the respective portions form first and second antenna arms 618' and 618", respectively. First and second antenna arms 618' and 618" together function as a bowtie antenna. First and second antenna arms 618' and 618" are connected with first and second feeds 619' and 619", respectively, in an edge-fed configuration as described in detail in the above incorporated U.S. Pat. No. 6,664,562 patent. Another portion of first and second non-insulating strips 614 and 616 overlap each other in a confronting, but electrically isolated relationship so as to define an overlap region 620. As shown in FIG. 7, first and second non-insulating strips 614 and 616 overlap completely in overlap region 620 in a manner analogous, for example, to overlap region 120 as shown in FIG. 2 and overlap region 420 of FIG. 5A. Furthermore, still another portion of first and second non-insulating strips 614 and 616 is configured to form a transition region 630, which is indicated within a dashed box. The configuration of transition region 630 is similar in design, for example, to transition region 130 of electron tunneling device 100 as shown in FIG. 2. The edge-fed configuration of first and second antenna arms 618' and 618", enables the feeding, for example, of low frequency signals into overlap region 620 without interfering with other high frequency signals that may be produced at overlap region 620 and emitted through antenna arms 618' and 618", and vice versa.

Figure 8:
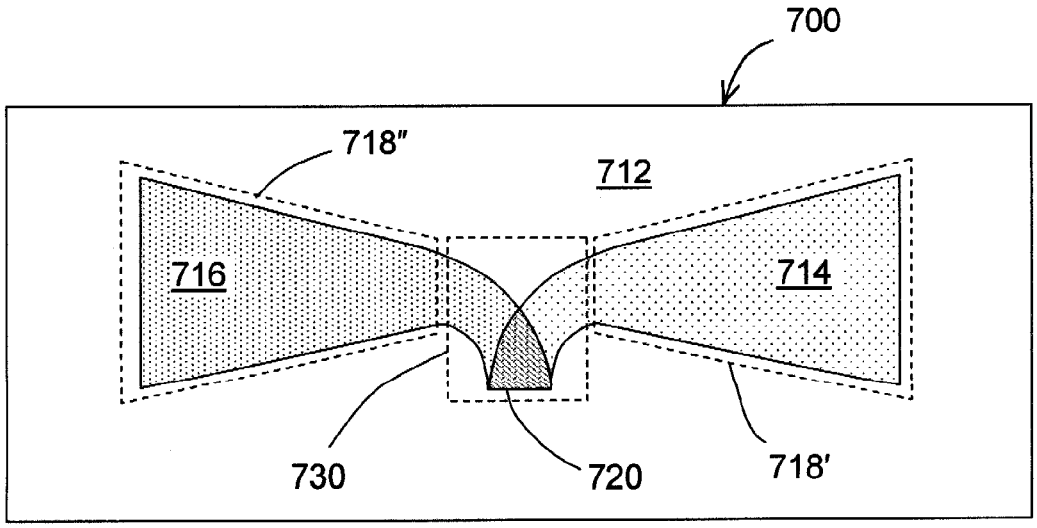
FIG. 8 is a diagrammatic plan view of a lumped diode configuration of the electron tunneling device according to the present disclosure.

Referring now to FIG. 8, a "lumped element" configuration of an electron tunneling device including a transition region is illustrated. An electron tunneling device 700 includes a substrate 712 on which first and second non-insulating strips 714 and 716 are disposed. A portion of each of first and second non-insulating strips 714 and 716 is configured to form first and second antenna arms (indicated within dashed enclosures 718' and 718"), respectively. Another portion of first and second non-insulating strips 714 and 716 overlap to form a small, overlap region, indicated by a shaded region 720. For a lumped element device, the device size is much less than the wavelength. Furthermore, still another portion of first and second non-insulating strips 714 and 716 are tapered into overlap region 720 in a transition region 730, within a dashed box. Electron tunneling device 700 is similar in spirit to the lumped element devices as described in the above incorporated U.S. Pat. Nos. 6,534,784 and 6,563,185 patents. That is, unlike the devices shown, for example, in FIGS. 1 and 4A of the present patent application, overlap region 720 is not elongated for purposes producing a traveling wave therethrough along a particular path . That is, electron tunneling device 700 combines the device configuration of the devices disclosed in the U.S. Pat. Nos. 6,534,784 and 6,563,185 patents with the transition region concept described herein.

In as much as the arrangements and associated methods disclosed herein may be provided in a variety of different configurations and modified in an unlimited number of different ways, it should be understood that the present invention may be embodied in many other specific forms without departing from the spirit or scope of the invention. For example, although each of the aforedescribed embodiments have been illustrated with various components having particular respective orientations, it should be understood that the present invention may take on a variety of specific configurations with the various components being located in a wide variety of positions and mutual orientations and still remain within the spirit and scope of the present invention. Furthermore, suitable equivalents may be used in place of or in addition to the various claim elements, the function and use of such substitute or additional equivalents being held to be familiar to those skilled in the art and are, therefore, regarded as falling within the scope of the present invention. Accordingly, having described a number of exemplary aspects and embodiments above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A device, comprising:

a first non-insulating strip and a second non-insulating strip spaced apart from one another such that first and second end portions, respectively, of the first and second non-insulating strips cooperate to form an antenna having an antenna impedance and said first and second non-insulating strips include a transition region that extends from said antenna to a tunneling region in which the first and second non-insulating strips are in a confronting relationship;

an arrangement cooperating with a portion of each of the first and second non-insulating strips in said tunneling region to form an electron tunneling structure exhibiting a tunneling region impedance, said arrangement being configured to support electron tunneling between and to said first and second non-insulating strips and said transition region is configured to match, at least to an approximation, said antenna impedance to said tunneling region impedance.

2. The device of claim 1 wherein said antenna is a planar antenna.

3. The device of claim 2 wherein said planar antenna is configured as a dipole antenna.

4. The device of claim 2 wherein said planar antenna is configured as a bowtie antenna.

5. The device of claim 2 wherein said planar antenna is configured as a vee antenna.

6. The device of claim 2 wherein said planar antenna is configured as a Vivaldi antenna.

7. The device of claim 2 wherein said planar antenna defines a first oscillation direction for supporting a first electromagnetic wave in a plane that is at least generally coplanar with the planar antenna.

8. The device of claim 7 wherein said tunneling junction produces said electron tunneling in said tunneling region at least generally perpendicular to said plane of the planar antenna, and said tunneling region is configured for supporting a second electromagnetic wave having a second oscillation direction that is at least generally perpendicular to said plane and said transition region is configured for rotating said first electromagnetic wave between said first oscillation direction at said planar antenna and said second oscillation direction at said tunneling region.

9. The device of claim 8 wherein said transition region includes a coplanar strip line (CPS) section and a parallel plate (PP) section, each of which is configured to contribute to an impedance match between said antenna impedance and said tunneling region impedance.

10. The device of claim 9 wherein said CPS section includes a quarterwave transformer (QWT) segment.

11. The device of claim 9 wherein said CPS section includes a taper that is configured to contribute to said impedance match.

12. The device of claim 9 wherein said PP section includes a taper that is configured to contribute to said impedance match.

13. The device of claim 9 wherein said CPS section includes a first CPS end and an opposing, second CPS end, which first CPS end is connected with said planar antenna, and said PP section includes a first PP end and an opposing, second PP end, which first PP end is connected with said second CPS end, and which second PP end is connected with said tunneling region.

14. The device of claim 13 wherein said CPS section exhibits a first CPS impedance at said first CPS end and a second CPS impedance at said second CPS end and said first CPS impedance is substantially matched in magnitude with said antenna impedance.

15. The device of claim 14 wherein said PP section exhibits a first PP impedance at said first PP end and a second PP impedance at said second PP end and said first PP impedance is substantially matched in magnitude with said second CPS impedance.

16. The device of claim 15 wherein said second PP impedance is substantially matched in magnitude with said tunneling region impedance.

17. The device of claim 1 wherein said first and second non-insulating strips including third and fourth portions, respectively, that cooperate to form an additional antenna exhibiting an additional antenna impedance at least generally across said tunneling region from said antenna, and said first and second strips include an additional transition region that extends from the additional antenna to the tunneling region to impedance match, at least to an approximation, said tunneling region impedance with said additional antenna impedance and to electromagnetically couple the tunneling region with the additional antenna.

18. The electron tunneling device of claim 17 wherein said additional antenna is planar in configuration, at least generally defining an additional antenna plane.

19. The electron tunneling device of claim 18 wherein said electron tunneling in said tunneling region occurs in a plane that is at least generally perpendicular to the additional antenna plane of the output planar antenna, and wherein said tunneling region is configured to support a first electromagnetic wave having a first oscillation direction that is at least generally perpendicular to the additional antenna plane and said additional antenna is configured to support a second magnetic wave having a second oscillation direction that is at least generally parallel with the additional antenna plane and said additional transition region is configured for rotating said first electromagnetic wave between said first oscillation direction at said tunneling region and said second oscillation direction at said additional antenna.

20. A method for producing a device, said method comprising:

forming a first non-insulating strip and a second non-insulating strip spaced apart from one another such that first and second end portions, respectively, of the first and second non-insulating strips cooperate to form an antenna having an antenna impedance and configuring said first and second non-insulating strips to include a transition region that extends from said antenna to a tunneling region in which the first and second non-insulating strips are in a confronting relationship;

configuring an arrangement to cooperate with a portion of each of the first and second non-insulating strips in said tunneling region to form an electron tunneling structure exhibiting a tunneling region impedance, and further configuring said arrangement to support electron tunneling between and to said first and second non-insulating strips and said transition region to match, at least to an approximation, said antenna impedance to said tunneling region impedance.

21. The method of claim 20 wherein said tunneling junction produces said electron tunneling in said tunneling region at least generally perpendicular to a plane that is defined by the planar antenna, and said planar antenna supports a first electromagnetic wave having a first oscillation direction, and configuring said tunneling region for supporting a second electromagnetic wave having a second oscillation direction that is perpendicular to said plane and further configuring said transition region to rotate said first electromagnetic wave between said first oscillation direction at said planar antenna and said second oscillation direction at said tunneling region.

* * * * *